US006064013A

United States Patent [19]

Robinson

[11] Patent Number: 6,064,013

[45] Date of Patent: May 16, 2000

[54] MINIATURE, PLANAR, INERTIALLY-DAMPED, INERTIALLY-ACTUATED DELAY SLIDER ACTUATOR

[75] Inventor: Charles H. Robinson, Silver Spring, Md.

[73] Assignee: The United States of America as represented by the Secretary of the Army, Washington, D.C.

[21] Appl. No.: 08/934,005

[22] Filed: Aug. 29, 1997

Related U.S. Application Data

[62] Division of application No. 08/791,706, Jan. 30, 1997, Pat. No. 5,705,767.

[51] Int. Cl.[7] ..... H01H 53/14

[52] U.S. Cl. ..... 200/61.53; 200/61.45 R; 200/61.5

[58] Field of Search ..... 200/34, 33 R, 200/61.45 R–61.45 M, 33 D, 323; 702/231, 262, 264, 222, 221, 233, 247–249

[56] References Cited

U.S. PATENT DOCUMENTS

| | | | |
|---|---|---|---|
| 2,475,730 | 7/1949 | Wandrey | 161/1 |
| 2,710,578 | 6/1955 | Rabinow | 102/70.2 |
| 4,195,575 | 4/1980 | Deuker et al. | 102/232 |
| 4,284,862 | 8/1981 | Overman et al. | 200/61.45 R |
| 4,421,031 | 12/1983 | Carter et al. | 102/252 |
| 4,770,096 | 9/1988 | Maruska et al. | 102/229 |
| 4,793,257 | 12/1988 | Bolieau | 102/221 |
| 4,815,381 | 3/1989 | Bullard | 102/247 |
| 4,891,255 | 1/1990 | Ciarlo | 428/131 |
| 5,705,767 | 1/1998 | Robinson | 102/231 |

*Primary Examiner*—Michael L. Gellner
*Assistant Examiner*—Nhung Nguyen
*Attorney, Agent, or Firm*—Paul S. Clohan, Jr.

[57] ABSTRACT

A miniature, planar, inertially-damped, inertially-actuated delay slider actuator is micromachined on a substrate and consists of a "slider", with zig-zag or stair-step-like patterns on the side edges, interacting with similar vertical-edged zig-zag patterns on "racks" which are positioned across a small gap on each side. The slider has been released from the substrate, and is captured vertically in its track by a non-interfering lattice or cover or other feature that bridges across from the top of one rack to the other. The racks are fixed to the substrate and the slider is forced axially down the "track" by an inertial load in the slider's axial direction. The slider is drawn along the track such that the "teeth" on the right edge of the slider engage with the teeth on the right rack. The slider is forced to move to the left as it slides down the faces on the right rack, until it is thrown clear of the right rack and goes across to engage similarly with the left rack. In this way the slider zig-zags under the continuing inertial forces as it also moves axially down the track toward the objective function. The time it takes to do this is the programmed delay. The objective function is anything the slider can act upon, such as a switch, a latch, a light beam, a capacitive pickup, etc.

5 Claims, 5 Drawing Sheets

MINIATURE, PLANAR, INERTIALLY-DAMPED, INERTIALLY-ACTUATED DELAY SLIDER ACTUATOR

CROSS-REFERENCE TO RELATED APPLICATIONS

This application is a division of application Ser. No. 08/791,706, filed Jan. 30, 1997, now U.S. Pat. No. 5,705,767.

STATEMENT REGARDING FEDERALLY SPONSORED RESEARCH OR DEVELOPMENT

Not Applicable.

BACKGROUND OF THE INVENTION

Mortar shells, artillery shells and other such explosive projectiles normally have a safing and arming device which operates to allow detonation of the explosive only after the projectile has been fired or launched. Often, the safing and arming circuit will comprise a switching device which responds to a "signature" or force due to firing, such as the setback acceleration or the spin of the projectile. It is essential that such a switching device responds only upon firing of the projectile and not react to impacts due to mishandling of the explosive shell. Switches known in the prior art which meet this need are generally complex gas- or liquid-damped designs or clockworks which are costly and require precision assembly of parts.

U.S. Pat. No. 4,284,862 shows an acceleration-actuated switch capable of distinguishing between random and brief acceleration forces on the one hand and sustained acceleration forces on the other hand. This device comprises a stationary electrical contact and a movable contact held in position by biasing means. Sustained acceleration forces in a particular direction will drive the movable contact along a fixed path to a position whereat the movable contact comes into proximity with the stationary contact thereby closing the switch. If the acceleration force is not in the proper direction or magnitude or is not applied to the switch for a sufficient length of time, the biasing means will return the movable contact to its original position thereby maintaining the switch in an open condition.

U.S. Pat. No. 4,814,381 shows an inertial arm/disarm switch having an inertial mass, a shaft with a zig zag channel, a gearless electric motor, a switch deck and blocking rotor, another blocking rotor, and a spring which provides a restoring force which acts against the inertia of the inertial mass. In this device, the blocking rotors have notches which interface with the associated inertial mass or masses and lock the rotors against rotative movement unless the inertial masses are in the proper positions.

The above cited prior art mechanical safe and arm devices all consist of three-dimensional zig zag delay devices on the scale of millimeters or centimeters, fashioned by precision machining, casting, or other such "macro" means to serve the purpose of providing a mechanical delay before closing a switch, or removing a detent on a detonator slider in a fuze S & A. To fabricate these devices is costly in that these devices are required to be extremely precision components often requiring time-consuming sorting of components, which limits the use of these types of devices.

In recent years, the LIGA technique has evolved as a basic fabrication process for the production of a large variety of microstructure products utilizing metals, polymers, ceramics and even glasses. The extreme precision of the microstructure products, their large aspect ratios for height vs. lateral dimension in combination with an inexpensive replication process opens a broad field of application for the fabrication of sensors, actuators, micromechanical components, microoptical systems, electrical and optical microconnectors. Deep X-ray lithography is the most important fabrication step in the sequence of the LIGA technique. It provides a three-dimensional master microstructure based on a radiation sensitive polymer material, which in general is reproduced in subsequent electroforming and molding processes.

BRIEF SUMMARY OF THE INVENTION

It is therefore an object of the present invention to reduce the size and cube of, while providing the same function as, mechanical delay devices used in projectile fuze safing and arming.

A further object of the present invention is to provide increased safing and arming device reliability and safety through inexpensive or efficient redundance of sensing and delay, latching, and actuating functions, including the use of arrays of scaled devices that can be used together to cover a range of inputs.

Still other objects and advantages of the present invention will become readily apparent to those skilled in this art from the detailed description, wherein only the preferred embodiment of the present invention is shown and described, simply by way of illustration of the best mode contemplated of carrying out the present invention. As will be realized, the present invention is capable of other and different embodiments, and its several details are capable of modifications in various obvious respects, all without departing from the present invention. Accordingly, the drawings and descriptions are to be regarded as illustrative in nature, and not as restrictive.

These and other objects are achieved by a miniature, planar, inertially-damped, inertially-actuated delay slider actuator which is micromachined on a substrate and consists of a "slider", with zig-zag or stair-step-like patterns (regular recursive features) on the side edges, interacting with similar vertical-edged zig-zag patterns on "racks" which are positioned across a small gap on each side. The "steps" can be other shapes, such as sinusoids, "ski-jumps", sawtooth, etc., i.e. any shape that causes the zig-zag motion. The slider has been released from the substrate, and is captured vertically in its track by a non-interfering lattice or cover or other feature that may completely or partially bridge across from the top of one rack to the other. The racks are fixed to the substrate and the slider is forced axially down the "track" by an inertial load in the slider's axial direction. The slider is drawn along the track such that the "teeth" on the right edge of the slider engage with the teeth on the right rack. The slider is forced to move to the left as it slides down the faces on the right rack, until it is thrown clear of the right rack and goes across to engage similarly with the left rack. The slider/rack combination is thus designed so the slider cannot merely fall through the rack. In this way the slider zig-zags under the continuing inertial forces (axial) as it also moves axially down the track toward the objective function. The time it takes to do this is the programmed delay. The objective function is anything the slider can act upon, such as a switch, a latch, a light beam, a capacitive pickup, etc.

The amount of delay provided by the device is programmed into the device by selecting: 1) the number of stages (a stage is one interaction of the slider with one rack before disengaging and moving across to engage with the opposite rack; 2) the angle and depth of the teeth or other recursive feature; and, 3) the restoring force supplied by the biasing element which can be a mechanical spring, a gas volume, an electrostatic or magnetic bias, etc. Items (1) and (2) determine the "throw" of the device. Selecting the thickness and planar dimensions of the features, and particularly the slider, determines the amount of force generated by the slider/actuator at the objective function. The delivered force is a function of the mass of the slider and the acceleration field at the slider, and the opposing force of the restoring bias. The purpose of the restoring bias means is to reset the slider to "home" position after brief non-launch inertial inputs have moved the slider part way down the track.

DETAILED DESCRIPTION OF THE INVENTION

Figure 1:
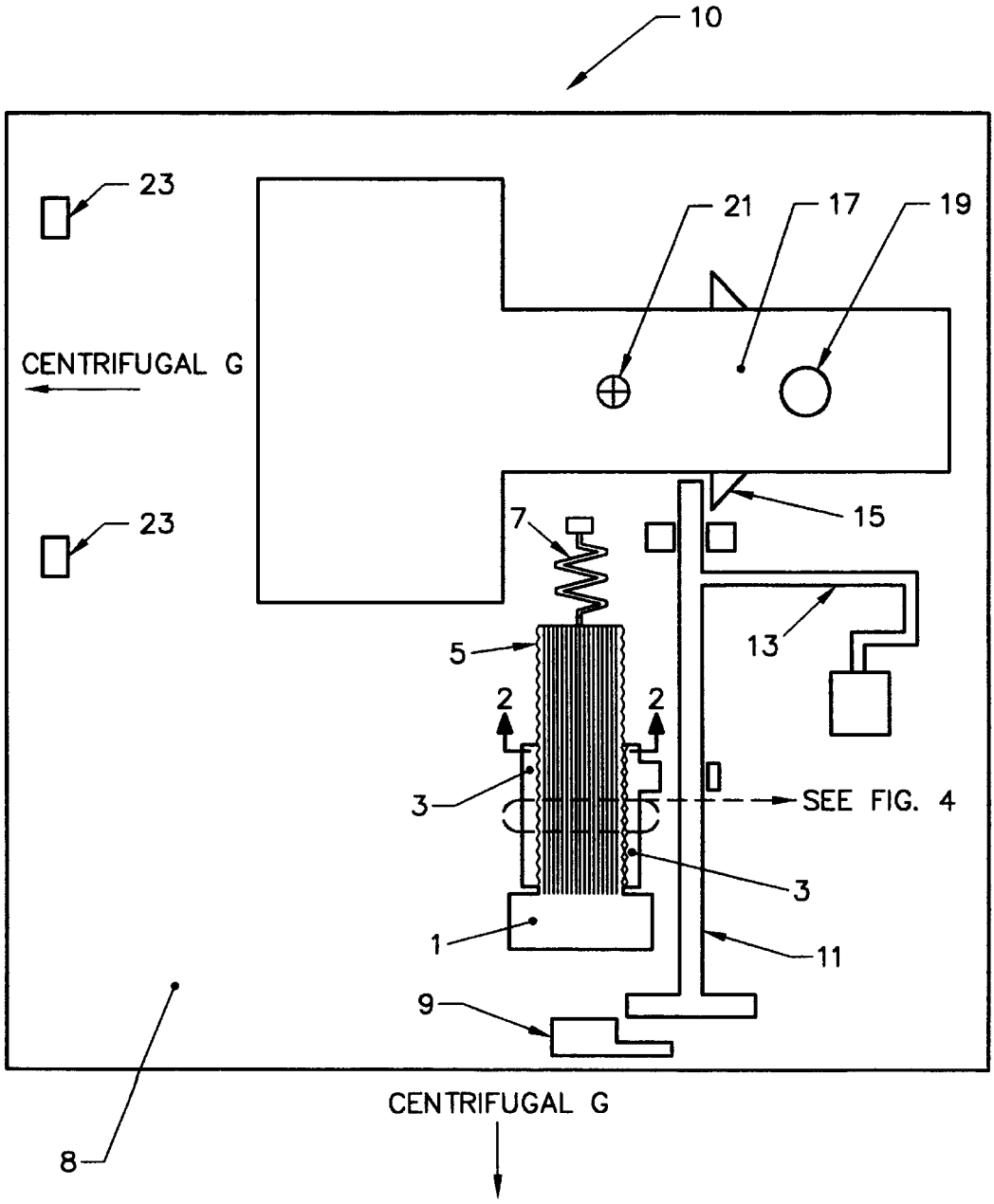
FIG. 1 is a plan view of a zig zag delay incorporating air flow induced damping to increase delay effect.
Figure 2:
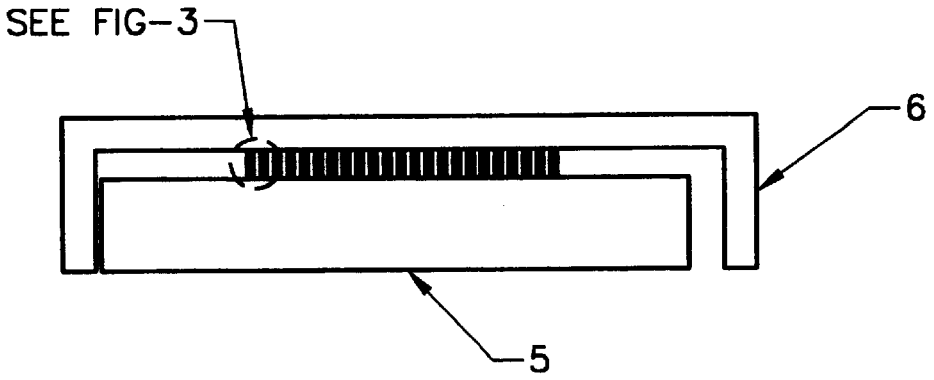
FIG. 2 is a detail view along lines 2—2 in FIG. 1.
Figure 3:
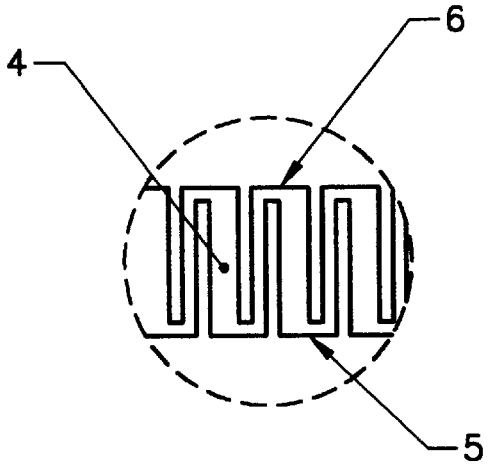
FIG. 3 is a detail view of a portion of FIG. 2.
Figure 4:
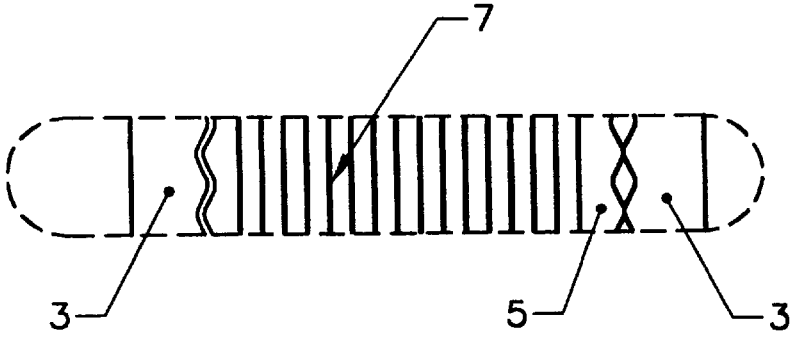
FIG. 4 is a detail view of a portion of FIG. 1.
Figure 5:
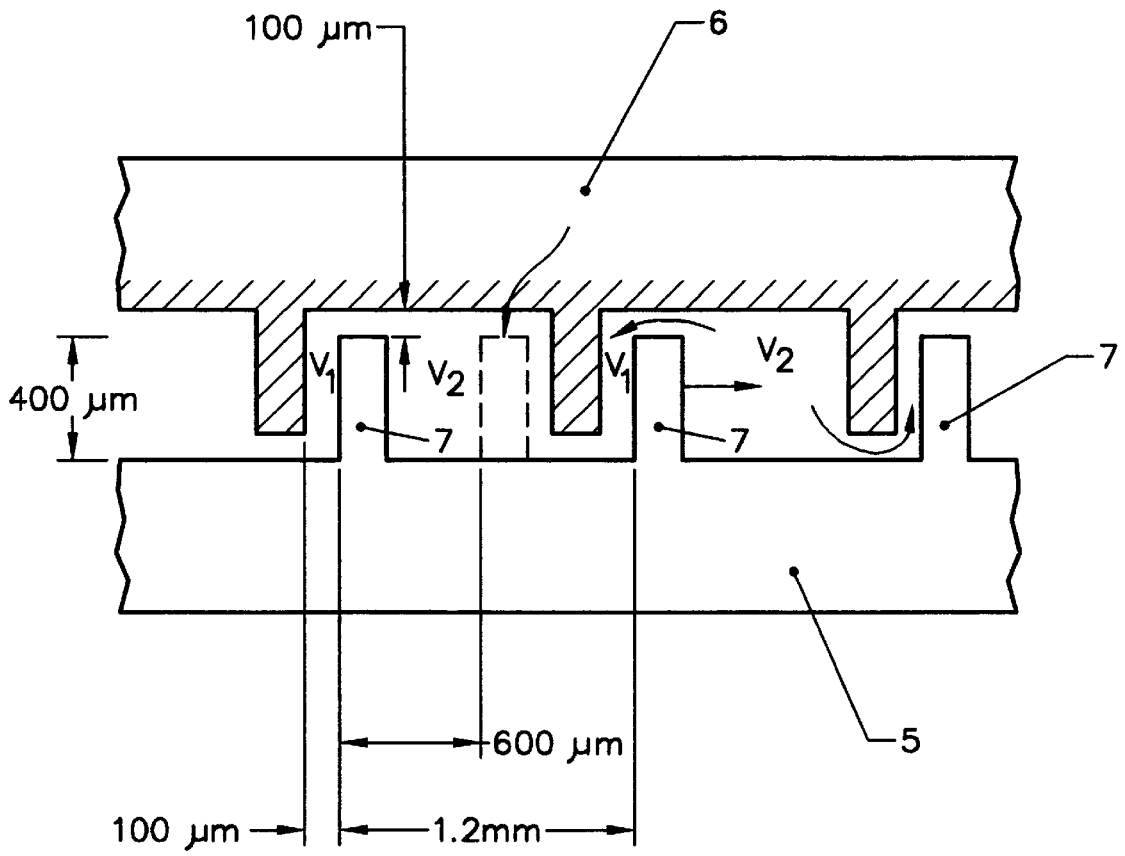
FIG. 5 show the fins for air damping the zig zag of FIG. 1.

FIG. 1 shows a miniature, planar, inertially-damped, inertially-actuated delay slider actuator 5 utilized in a unique fuze safing and arming device 10. The device contains a planar delay mechanism consisting of two racks of teeth 3 facing each other and anchored to wafer substrate 8. An actuating slider 5 is the zig-zag mass and moves along the track formed between the two racks 3. A biasing means such as a restraining or reset spring 7 (biased or unbiased) functions to return slider 5 to its original position after low-level or short-duration inputs have moved slider 5 a small amount from its original position. Low level or short-duration shock inputs may be due to handling of the device prior to its intended use. During sustained acceleration, such as during the "setback" acceleration or spin-induced acceleration of projectile launch, the slider/actuator 5 is propelled down the track under inertial load, to where it reaches the "objective function" at the end of the run, in this case illustrated by release rod 11. Stop 9 functions to limit the travel of mass 1 on actuator 5 and rod 11. Rod 11 is held in position by spring 13. Spring 13 will not allow rod 11 to move downwards without force from slider 5 and mass 1 under the same inertial load. The teeth in racks 3 and slider 5 are matching in pitch and tooth angle. The rack teeth are positioned to allow slider 5 to move back and forth down the track between racks 3, allowing a small amount of lateral clearance so the device does not jam. It does not matter whether slider 5 teeth are symmetrical about the slider axis or matching in tooth angle or shape with the rack teeth but only that whatever the configuration, slider 5 will be forced to travel down the track only by going back and forth between the rack sides.

An example of four tested zig-zag delays fabricated according to the present inventive technique are shown in Table 1.

TABLE 1

| Device # | Tooth Angle | Side Stroke | Slider Throw | # of States | Safe Drop Height* |
|---|---|---|---|---|---|
| 1 | 60° | 0.3 mm | 4 mm | 9 | 28 ft |
| 2 | 50° | 0.3 mm | 4 mm | 11 | 42 ft |
| 3 | 55° | 0.25 mm | 4 mm | 12 | 42 ft |
| 4 | 50° | 0.25 mm | 4 mm | 14 | 58 ft |

*A Safe Drop Height goal is a minimum of 40 ft.

A tooth angle of 60° means the faces of a given tooth meet at a 120° angle. The side stroke describes how far slider 5 moves going from one side to the other while bumping down the track. The throw is how far slider 5 travels axially before it engages with stop 9. The number of stages is how many changes of direction (bumps) slider 5 undergoes and the safe drop height indicates the calculated height from which the device could be dropped and just be on the threshold of arming (hitting stop 9). Each device was spun at a 1-in radius at 1,380 RPM.

When slider 5 moves rod 11 against stop 9, it unlatches detonator slider 17 via latch 15. Detonator slider 17 then moves by centrifugal force to stops 23 to allow detonator 19 to line-up with the explosive train of the fuze, which arms the fuze. Although the embodiment of FIG. 1 is towards a fuze safety and arming device, any objective function or feature could be employed for the zig-zag slider to operate on, such as a light beam, a capacitor electrode, an electrostatic electrode, a trip lever, elements of a switch, etc.

It is desirable in some cases to further dampen the downward movement of slider 5. Inertial damping of slider 5 downward motion results from the rapid reversals in direction of motion (left and right as pictured) caused by the interaction of slider 5 with rack teeth 3. As shown in FIGS. 2, 3, 4 and 5, the inertial-damping delay effects can be augmented with airflow-induced damping losses which occur between the interleaved vertical fins 7 formed on slider 5 and on an inverted cover plate 6 located above slider 5. Air is forced to move back and forth from a given cavity between slider 5 fins 7 and cover fins into the adjacent cavities. Each time the air moves it must pass through a relatively narrow constriction, the clearance between the fin "lands" and the opposing substrate. The amount of fluidic damping is "tunable" by selecting the leak-path gap (constriction) width, the number and size of fin-pairs interacting, and by programming the mean velocity of the slider relative to the stationary fins.

Figure 6:
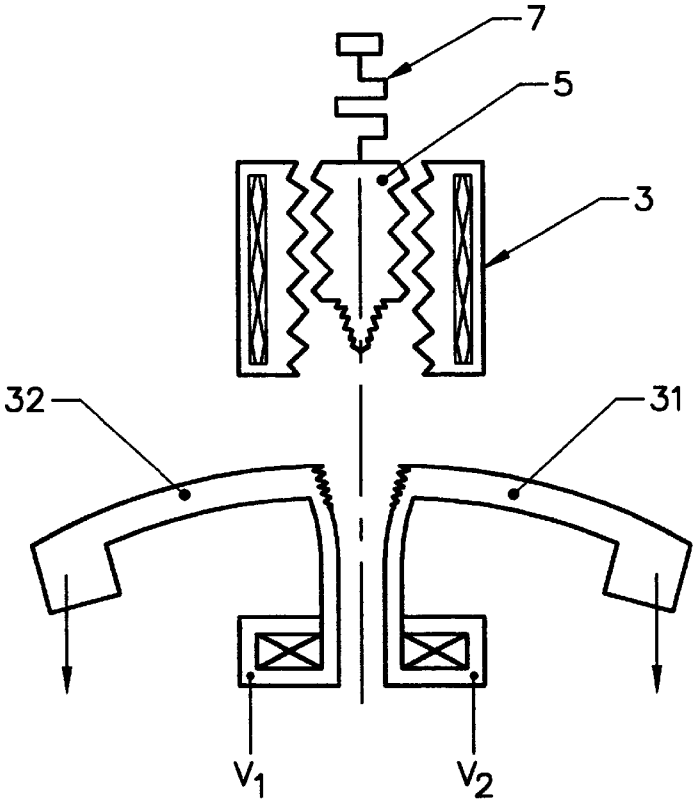
FIG. 6 shows a device for combining a delay function with a latching switch, prior to activation.
Figure 7:
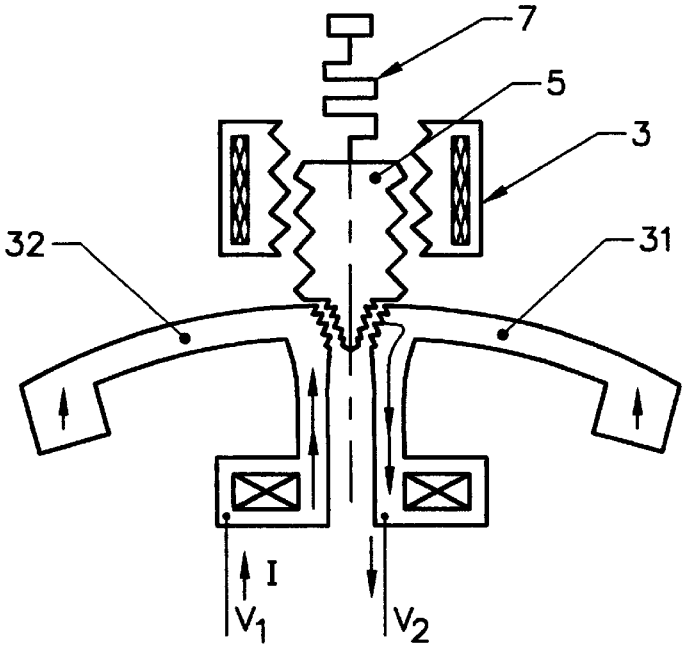
FIG. 7 shows the device of FIG. 6 after activation.
Figure 8:
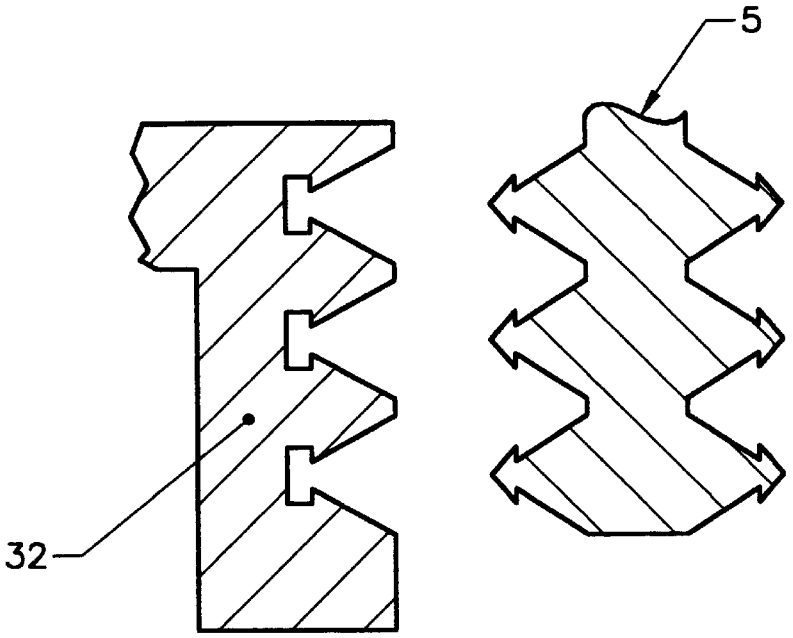
FIG. 8 is a detail of a latch configuration.

FIGS. 6 & 7 show an alternate embodiment of a miniature, planar, inertially-damped, inertially-actuated delay slider actuator. FIG. 6 shows a device for combining a delay function with a latching switch, prior to activation. A voltage potential is placed across points $V_1$–$V_2$ such that members (i.e., cantilevered arms) 31 and 32 form an open switch. During sustained acceleration, members 31 and 32 bend downward, as shown, and slider 5 engages members 31 and 32 as shown in FIG. 7 and latches. This completes the circuit and current is allowed to flow. The device tends to stay latched because of the relaxation of members 31 and 32; also, a permanent latching member can be provided. The details of the permanent latching portion of this embodiment are shown in FIG. 8.

Figure 9:
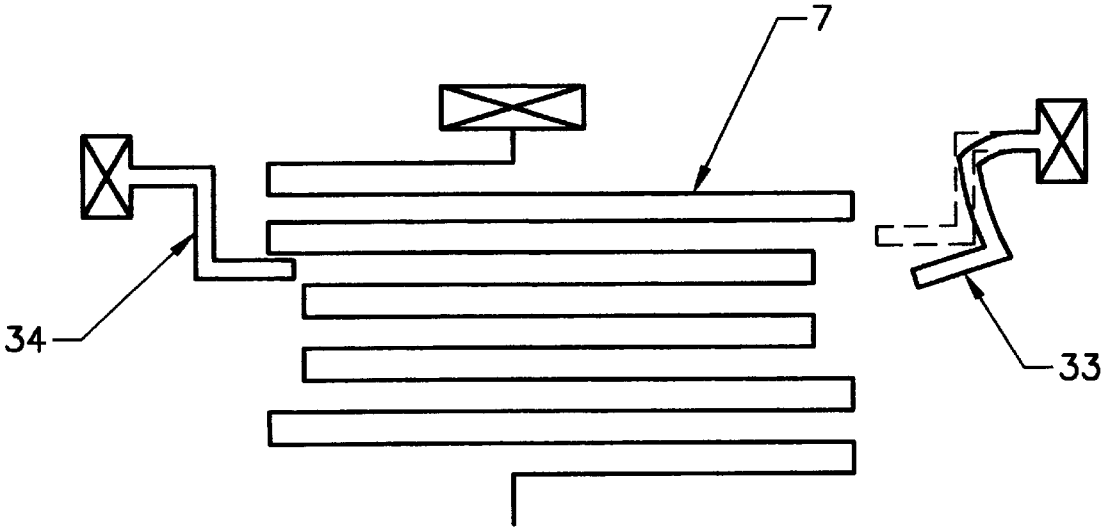
FIG. 9 shows a non-linear reset spring that may be used in a zig zag delay.

FIG. 9 shows the details of a non-linear spring 7 that can be utilized to allow only a part of the spring to deflect for small inertial inputs, such a those encountered during handling. The spring is relatively stiff, but when the intended operating input occurs, such as during setback or spin in a fuze S & A application, the entire spring is deployed because of auxiliary restraint springs 33 and 34 also deflect and release the slider reset spring 7. Right auxiliary restraint spring 33 is shown as it would be deflected under high G forces for purposes of illustration.

Any solid material or combination of materials could be used to form slider 5. The present embodiment has the slider and racks formed of metal, such as nickel, but other materials including other metals or polymers or even crystalline materials such as silicon or quarts, could be used. The material chosen is not critical, unless conductivity is an issue when the slider is used in applications such as completing an electrical circuit. Also, the device need not be of any particular size. The device will function whether slider 5 is 8 cm along its axis or 8 mm or 0.8 mm, although practicality of fabrication may limit the size. Also, the height of the features of device 10 is not particularly important, given that there is enough material for slider 5 and racks 3 to interact in the intended way. The proportions of the device may be changed, for example, to deliver a stronger force to the objective, a larger or smaller or thicker slider or a larger number of "stages" may be designed, without materially changing its embodiment. Any technology may be used to form the device, whether a LIGA-type process or a bulk plasma micromachining technique, or some other process yielding the desired configurations.

The miniature, planar, inertially-damped, inertially-actuated delay slider actuator is superior to prior art devices because it is essentially "planar" in form, having micromachined features of only 50 to 500 micrometers in height above the substrate, therefore providing the possibility of slimmer projectile fuzing S & A devices, or slimmer devices for any of its applications. The feature size and precision of the miniature, planar, inertially-damped, inertially-actuated delay slider actuator is limited only by the accuracy and resolution of the fabrication process. For LIGA this is currently on the order of 0.1 micrometers or better. This is in contrast with the dimensional tolerances and feature resolution of precision obtainable with traditional tool machining or casting or forging techniques. The miniature, planar, inertially-damped, inertially-actuated delay slider actuator could be implemented, for instance, with the slider being only 2 millimeters or less in length, and 200 micrometers or less in height above the substrate, which is much smaller than existing zig-zag delay devices. Also, because of the fabrication process, other mechanical or electrical functions, with which the present device will be intended to interact, can be formed on the same substrate at the same time through the same micromachining process. The fabrication can be done such that electronic circuitry can also be built into or onto the same substrate as the device, so that this device may interface readily with electronic sensors or pickups which detect its motion or its actuation of some other function. When the device is fabricated using a micromachining process, the amount of delay, which is "programmed" into the device by selecting the number of stages which will interact, the angle of the teeth, the depth of the teeth, or the use of damping fins, can be changed fairly easily by changing the mask from which the part is made. This is in contrast to the changes in tooling or molds needed to make larger parts as in traditional mechanical S & A's.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

I claim:

1. A planar acceleration operated switch comprising:

a wafer substrate;

a planar delay mechanism affixed to said planar substrate consisting of an inertially dampened moveable mass that moves in a linear direction in response to acceleration forces on said planar substrate;

a biasing means to retain said moveable mass at a resting position;

a barbed engagement end on said moveable mass;

a pair of cantilevered arms affixed at one end to said substrate and separated such that said barbed engagement end will mate with a similar barb-configured portion on said cantilevered arms thereby causing an electrical connection to be made between said cantilevered arms.

2. The device of claim 1 wherein said delay mechanism consists of:

two racks of teeth facing each other and anchored to said substrate;

said moveable mass interposed between said two racks of teeth and having teeth on either side for engagement and disengagement with said two racks of teeth.

3. A planar acceleration operated switch device comprising:

a wafer substrate;

a planar delay mechanism affixed to said planar substrate consisting of an inertially dampened moveable mass that moves in a linear direction in response to acceleration forces on said substrate;

a biasing means to retain said moveable mass at a resting position;

a stop affixed to said wafer substrate to limit the travel of said moveable mass to a final position;

a member affixed to said wafer substrate and acted upon by said moveable mass, wherein said member activated an objective function on said substrate.

4. The device of claim 3 wherein said delay mechanism consists of:

two racks of teeth facing each other and anchored to said substrate;

said moveable mass interposed between said two racks of teeth and having teeth on either side for engagement and disengagement with said two racks of teeth.

5. The device of claim 4 further comprising additional damping means acting on said delay mechanism.

* * * * *